US010029867B2

(12) United States Patent
Cheng et al.

(10) Patent No.: US 10,029,867 B2
(45) Date of Patent: Jul. 24, 2018

(54) FEEDING DEVICE

(71) Applicant: AVISION INC., Hsinchu (TW)

(72) Inventors: Sung-Po Cheng, Hsinchu (TW); Thomas Sheng, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/886,112

(22) Filed: Oct. 19, 2015

(65) Prior Publication Data

US 2016/0114991 A1 Apr. 28, 2016

(30) Foreign Application Priority Data

Oct. 27, 2014 (TW) ..... 103136947 A

(51) Int. Cl.

| | |
|---|---|
| ***B65H 3/04*** | (2006.01) |
| ***B65H 3/06*** | (2006.01) |
| ***B65H 3/52*** | (2006.01) |
| ***B65H 7/02*** | (2006.01) |

(52) U.S. Cl.

CPC ..... *B65H 3/0669* (2013.01); *B65H 3/042* (2013.01); *B65H 3/063* (2013.01); *B65H 3/523* (2013.01); *B65H 3/5238* (2013.01); *B65H 7/02* (2013.01); *B65H 2404/253* (2013.01); *B65H 2404/2693* (2013.01); *B65H 2511/51* (2013.01); *B65H 2513/11* (2013.01); *B65H 2513/40* (2013.01)

(58) Field of Classification Search

CPC ..... B65H 3/042; B65H 3/047; B65H 3/04; B65H 3/063; B65H 3/0676; B65H 3/0684; B65H 3/0615; B65H 3/0638; B65H 3/5238

See application file for complete search history.

(56) References Cited

U.S. PATENT DOCUMENTS

| | | | | |
|---|---|---|---|---|
| 3,934,869 A * | 1/1976 | Strobel, Jr. | ..... | B65H 3/042 271/166 |
| 4,174,102 A * | 11/1979 | Clausing | ..... | B65H 3/042 271/165 |
| 5,244,197 A * | 9/1993 | Helmstadter | ..... | B65H 5/025 271/117 |
| 5,344,134 A * | 9/1994 | Saeki | ..... | B65H 3/06 271/10.04 |

(Continued)

FOREIGN PATENT DOCUMENTS

| | | |
|---|---|---|
| CN | 1803562 A | 7/2006 |
| CN | 201002893 Y | 1/2008 |

(Continued)

*Primary Examiner* — Luis A Gonzalez

(57) ABSTRACT

A feeding device for digital processing machine includes a paper passage, a friction device, and a sheet-feeding module. The sheet-feeding module is disposed in the paper passage and opposite to the friction device. The sheet-feeding module includes a sheet-feeding roller, a first idle wheel, and a belt. The sheet-feeding roller is for separating a sheet with the friction device. The first idle wheel is disposed in the upstream side of the sheet-feeding roller. The belt encircles the first idle wheel and the axle of the sheet-feeding roller. The sheet-feeding module rotates from a first position to a second position when the sheet-feeding roller rotates, such that the belt contacts the sheet when the sheet-feeding module is at the second position.

8 Claims, 10 Drawing Sheets

(56) References Cited

U.S. PATENT DOCUMENTS

| | | | | |
|---|---|---|---|---|
| 7,192,025 | B1 * | 3/2007 | Golicz | B65H 1/22 271/34 |
| 2013/0221606 | A1 * | 8/2013 | Lai | B65H 3/06 271/34 |
| 2015/0360890 | A1 * | 12/2015 | Hwang | B65H 3/0684 271/10.01 |

FOREIGN PATENT DOCUMENTS

| | | | | |
|---|---|---|---|---|
| CN | 204528743 | U | | 8/2015 |
| JP | 58183541 | A | * | 10/1983 |
| JP | 6144603 | | | 5/1994 |
| JP | 06144603 | A | * | 5/1994 |
| JP | 06316343 | A | * | 11/1994 |
| JP | 200085985 | | | 3/2000 |
| JP | 2000085985 | A | * | 3/2000 |
| TW | I310736 | B | | 6/2009 |

* cited by examiner

FEEDING DEVICE

BACKGROUND OF THE INVENTION

1. Field of the Invention

The present invention relates to a feeding device, and more particularly, to a feeding device utilizing a belt to prevent a paper jam of a digital processing machine.

2. Description of the Prior Art

Digital processing machines, such as scanners, copy machines, and multifunction printers, are often equipped with automatic document feeders (ADFs) for users to put a plurality of sheets at once instead of one by one manually. Please refer to FIG. 9. FIG. 9 is a diagram of a conventional feeding device in the prior art. As shown in FIG. 9, a plurality of sheets S is put in a paper passage P. A feeding device senses the sheets S and drives a sheet-feeding roller A to rotate. The sheet-feeding roller A cooperates with a friction pad B to separate the plurality of sheets S and feed the plurality of sheets S one by one to the paper passage P at a downstream of the sheet-feeding roller A. However, the sheets S may not be so rigid that the sheets are bent or creased by a force when being placed or by a friction variation on the paper passage P, even getting stuck into a seam. This situation is more likely to happen when feeding the thin sheets S. As shown in FIG. 9, the sheets S may get stuck into a seam near the sheet-feeding roller A and the paper passage P.

FIG. 10 is a diagram of another conventional feeding device in the prior art. As shown in FIG. 10, a pickup roller C is added at an upstream side of the sheet-feeding roller A. The feeding device can sense the approaching sheets S, and then the pickup roller C holds and conveys the plurality of sheets S to the sheet-feeding roller A and the friction pad B. At this moment, the sheets S might get stuck into a seam between the pickup roller C and the sheet-feeding roller A or a seam between the sheet-feeding roller A and the paper passage P. Since a paper jam causes damage to sheets and inconvenience when people use digital processing machines, there is a need to develop an effective mechanism to solve the above-mentioned problems.

SUMMARY OF THE INVENTION

In order to solve the above-mentioned drawbacks, the present invention is to provide a feeding device capable of guiding sheets to pass through a seam between a sheet-feeding roller and a paper passage or a seam between a pickup roller and a sheet-feeding roller for preventing the sheets from getting stuck into the seams, so as to protect the sheets from damage and to ensure a smooth sheet-feeding process.

According to the claimed invention, a feeding device for a digital processing machine includes a paper passage, a friction device, and a sheet-feeding module. The sheet-feeding module is disposed on the paper passage and at a location opposite to the friction device. The sheet-feeding module includes a sheet-feeding roller, a first idle wheel, and a belt. The sheet-feeding roller is for separating a sheet with the friction device. The first idle wheel is disposed on an upstream side of the sheet-feeding roller. The belt encircles the first idle wheel and an axle of the sheet-feeding roller. The sheet-feeding module rotates from a first position to a second position when the sheet-feeding roller rotates, such that the belt contacts the sheet when the sheet-feeding module is at the second position.

According to the claimed invention, the sheet-feeding module further includes a supporting frame installed on the axle of the sheet-feeding roller, and the belt encircles the supporting frame and the axle of the sheet-feeding roller.

According to the claimed invention, the second position is higher than the first position along a direction substantially perpendicular to the paper passage.

According to the claimed invention, the belt is driven by the sheet-feeding roller to drive the sheet.

According to the claimed invention, the feeding device further includes a power source connected to the sheet-feeding roller and for driving the sheet-feeding roller to rotate.

According to the claimed invention, the feeding device further includes a pickup roller disposed on the paper passage and at an upstream side relative to the sheet-feeding roller. The pickup roller is for conveying the sheet to the sheet-feeding roller.

According to the claimed invention, the feeding device further includes an additional pickup roller disposed coaxially with the pickup roller.

According to the claimed invention, the sheet-feeding module further includes an additional sheet-feeding roller disposed coaxially with the sheet-feeding roller.

According to the claimed invention, the sheet-feeding module includes a second idle wheel disposed between the first idle wheel and the sheet-feeding roller, and the belt further encircles the second idle wheel.

According to the claimed invention, the sheet-feeding module includes a third idle wheel disposed at a downstream side of the sheet-feeding roller, and the belt further encircles the third idle wheel.

In summary, the present invention provides the feeding device capable of guiding the sheet by utilizing the belt to contact the sheet and drive the sheet to move when the sheet is picked up or separated, such that the sheet is not extremely bent by a force. Therefore, the sheet can pass through a space between the paper passage and the sheet-feeding roller or between the pickup roller and the sheet-feeding roller, instead of being stuck into seams therebetween, and can be conveyed to the paper passage at the downstream of the sheet feeding roller one by one continuously, which protects the sheet from damage and ensures a smooth sheet-feeding process.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
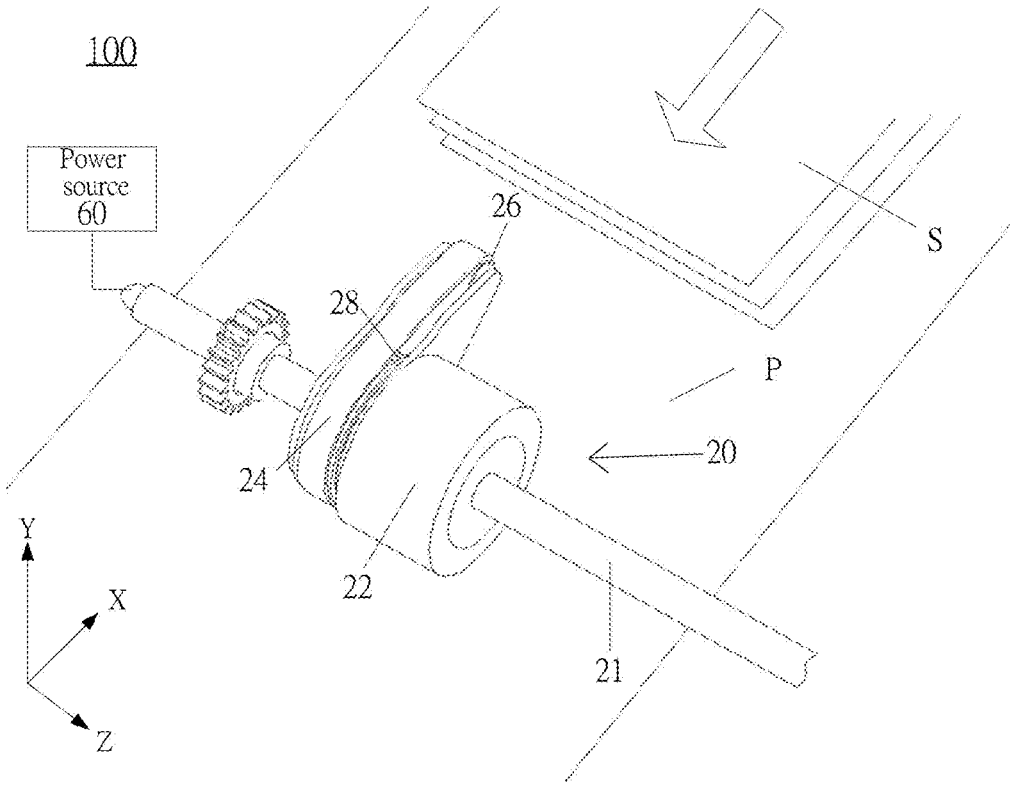
FIG. 1 is a schematic diagram of a feeding device according to a first embodiment of the present invention.

Please refer to FIG. 1. FIG. 1 is a schematic diagram of a feeding device 100 according to a first embodiment of the present invention. The feeding device 100 is disposed at a sheet-feeding side of a digital processing machine (not shown in FIG. 1). The feeding device 100 includes a paper passage P, a sheet-feeding module 20, a friction device 30, and a power source 60. The sheet-feeding module 20 is disposed on the paper passage P. The sheet-feeding module 20 includes an axle 21, a sheet-feeding roller 22, a belt 24, and a first idle wheel 26. The sheet-feeding roller 22 is sheathed on the axle 21 for cooperating with the friction device 26 to separate a sheet S. The belt 24 encircles the first idle wheel 26 and the axle 21. The power source 60 is connected to the sheet-feeding roller 22 for driving the sheet-feeding roller 22 to rotate. Furthermore, since a diameter of the axle 21 is much less than a diameter of the sheet-feeding roller 22, in order to improve a feeding effect of the belt 24, the sheet-feeding module 20 further includes a supporting frame 28 installed on the axle 21, and the belt 24 encircles the supporting frame 28 and the axle 21, such that an end of the belt 24 near the sheet-feeding roller 22 can contact the sheet S more easily.

Figure 2:
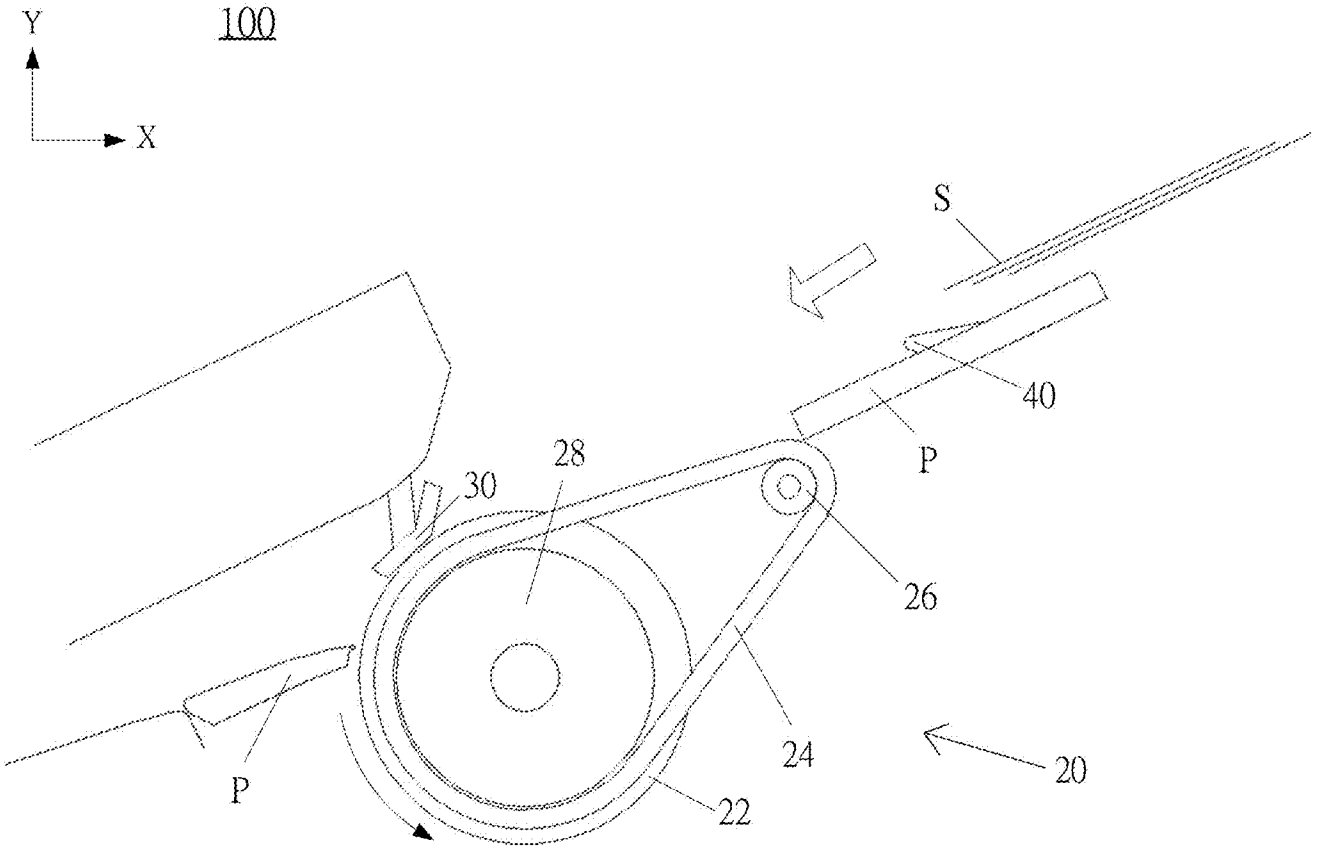
FIG. 2 is a diagram of the feeding device with a sheet-feeding module in a first position according to the first embodiment of the present invention.

Please refer to FIG. 2. FIG. 2 is a diagram of the feeding device 100 with the sheet-feeding module 20 in a first position according to the first embodiment of the present invention. As shown in FIG. 2, the sheet-feeding module 20 is disposed at a location opposite to the friction device 30. The first idle wheel 26 is disposed at an upstream side of the sheet-feeding roller 22. The relative relation between the upstream side and a downstream side is defined by a sheet-feeding direction illustrated in a bold arrow, as shown in FIG. 2. In other words, the sheet S passes through the upstream side of a sheet-feeding side of a digital processing machine and then passes through the downstream side. The friction device 30 can be a friction wheel or a friction pad. As shown in FIG. 2, in this embodiment, the friction device 30 is a friction pad but is not limited to this embodiment. The feeding device 100 further includes a detecting device 40 disposed on the paper passage P for detecting whether the sheet S enters into the paper passage P. The detecting device 40 can be, but not limited to, an infrared detector, a mechanical detector, or an ultrasonic detector. When the sheet S does not enter into the paper passage P, the sheet-feeding roller 22 does not rotate, and the sheet-feeding module 20 is at the first position, i.e., where the first idle wheel 26 of the sheet-feeding module 20 is lower than the paper passage P at the upstream side of the sheet-feeding roller 22.

Figure 3:
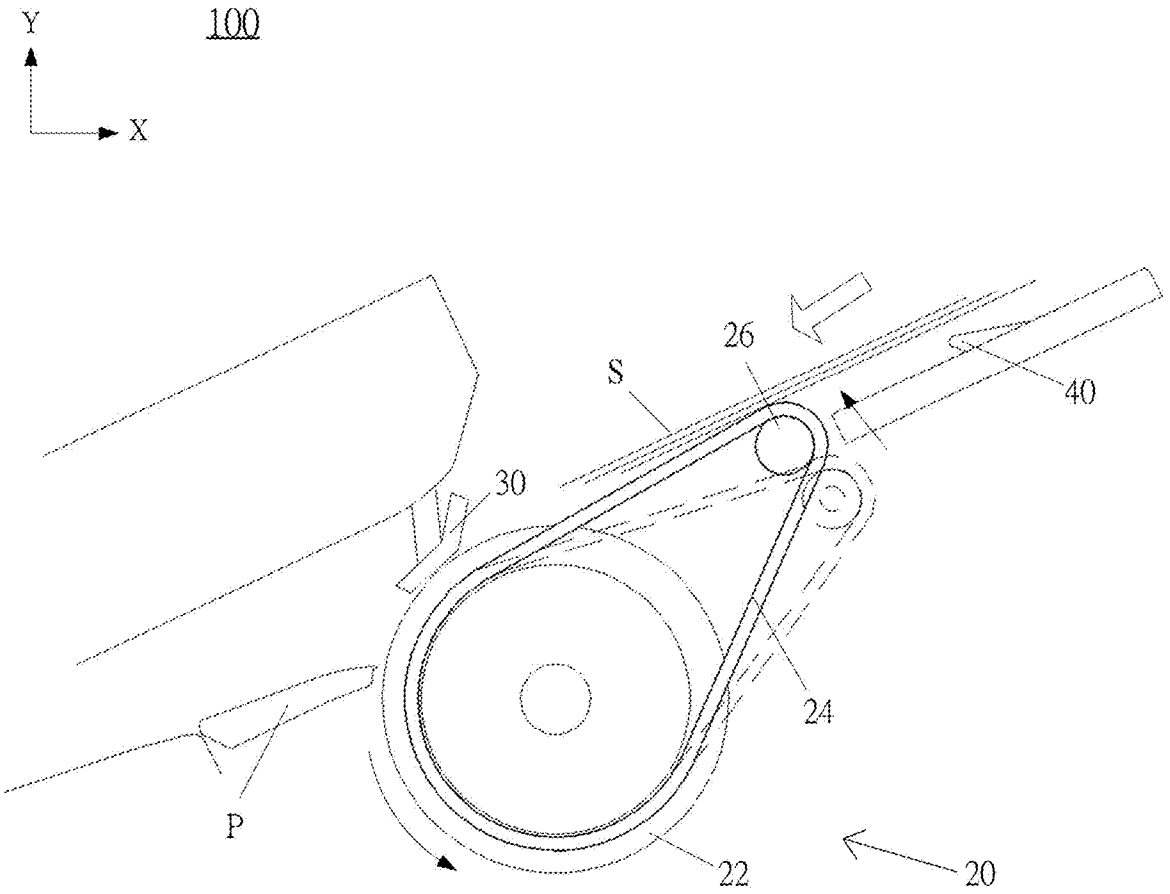
FIG. 3 is a diagram of the feeding device with the sheet-feeding module in a second position according to the first embodiment of the present invention.

Please refer to FIG. 3. FIG. 3 is a diagram of the feeding device 100 with the sheet-feeding module 20 in a second position according to the first embodiment of the present invention. As shown in FIG. 3, after the sheet S is detected by the detecting device 40, the power source 60 drives the sheet-feeding roller 22 of the sheet-feeding module 20 to rotate in a counterclockwise direction and drives the sheet-feeding module 20 to rotate from the first position (illustrated in dashed lines shown in FIG. 3) to the second position (illustrated in solid lines shown in FIG. 3). The second position is higher than the first position in a direction substantially perpendicular to the paper passage P. In other words, the first idle wheel 26 is higher than the paper passage P at the upstream side of the sheet-feeding roller 22 when the first idle wheel 26 is located at the second position. The operational mechanism can be achieved by installing a reverse one-way bearing on the axle 21 or by a solenoid valve to move the first idle wheel 26 up and down, such that the belt 24 contacts the sheet S at the second position. The sheet-feeding roller 22 rotates and drives the belt 24 to rotate simultaneously, which allows the belt 24 to convey the sheet S and ensure a smooth sheet-feeding process. For example, when a downward force of the sheet S put by a user is too large, the sheet S can be avoided from being bent and pass though the paper passage P and the sheet-feeding roller 22 smoothly, instead of being stuck into a seam between the paper passage P and the sheet-feeding roller 22, by rotating the first idle wheel 26 to the second position and driving the belt 24 to rotate.

Figure 4:
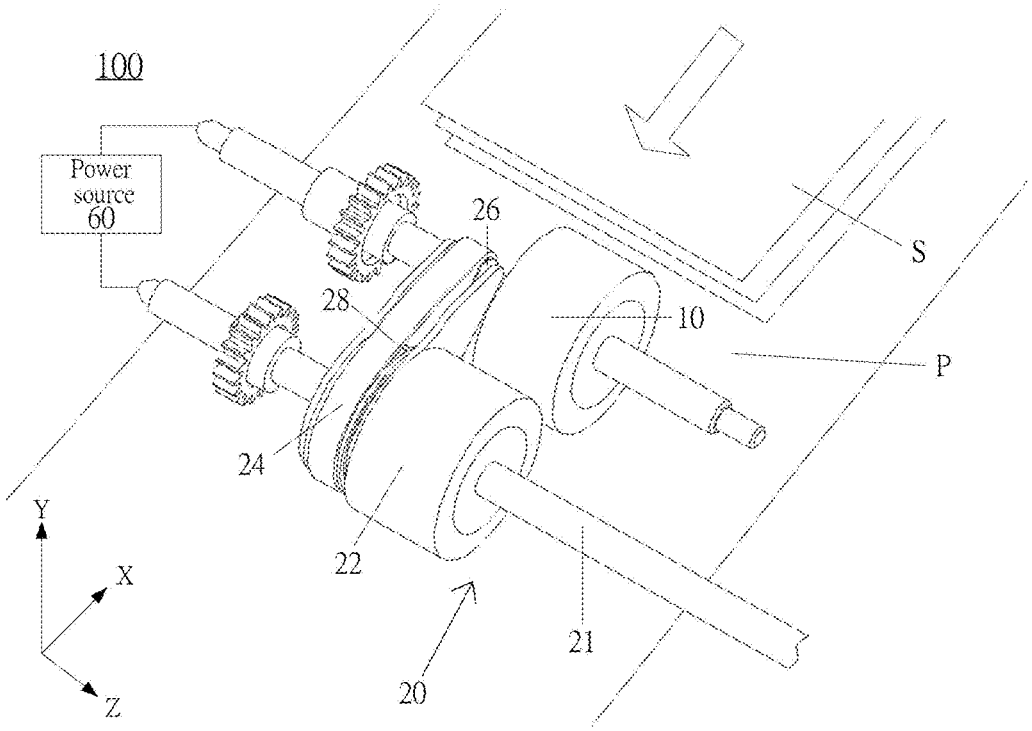
FIG. 4 is a schematic diagram of the feeding device according to a second embodiment of the present invention.
Figure 5:
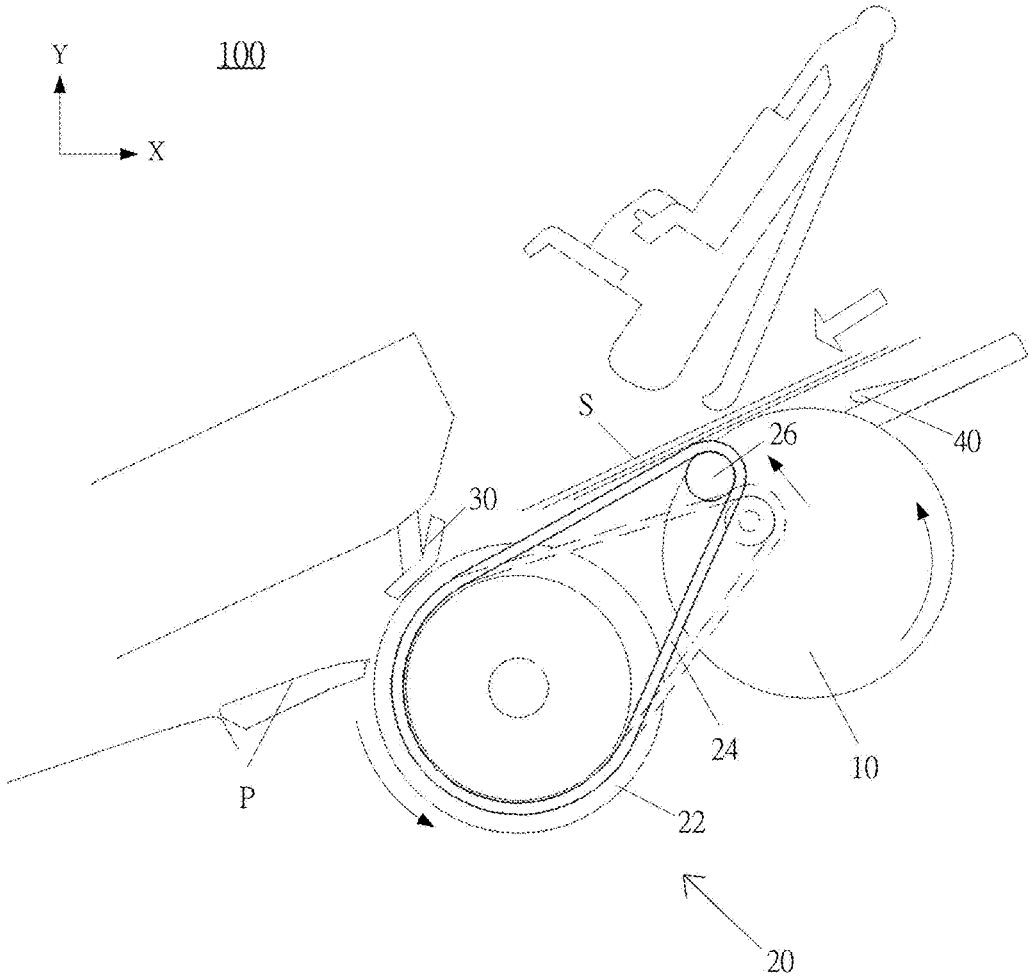
FIG. 5 is a diagram of the feeding device with the sheet-feeding module in a second position according to the second embodiment of the present invention.

Please refer to FIG. 4 and FIG. 5. FIG. 4 is a diagram of the feeding device 100 according to a second embodiment of the present invention. FIG. 5 is a diagram of the feeding device 100 with the sheet-feeding module 20 in a second position according to the second embodiment of the present invention. Different from the first embodiment, the feeding device 100 further include a pickup roller 10. The pickup roller 10 and the sheet-feeding module 20 are disposed on the paper passage P. The pickup roller 10 is located at an upstream side relative to the sheet-feeding roller 22. As shown in FIG. 5, after the sheet S is detected by the detecting device 40, the power source 60 drives the pickup roller 10 to rotate in a counterclockwise direction, so as to convey the sheet S to the sheet-feeding roller 22. Meantime, the sheet-feeding module 20 is driven to rotate from a first position (illustrated in dashed lines) to the second position (illustrated in solid lines) by the power source 60. The second position is higher than the first position in the direction substantially perpendicular to the paper passage P. The belt 24 contacts the sheet S at the second position by movement of the first idle wheel 26. Since the sheet-feeding roller 22 rotates and drives the belt 24 to rotate simultaneously, the belt 24 can help to convey the sheet S and ensure a smooth sheet-feeding process. For example, when a downward force that the pickup roller 10 holds the sheet S is too large, the sheet S can be avoided from being bent and pass through the pickup roller 10 and sheet-feeding roller 22 smoothly, instead of being stuck into a seam between the pickup roller 10 and the sheet-feeding roller 22, by rotating the first idle wheel 26 to the second position and driving the belt 24.

Figure 6:
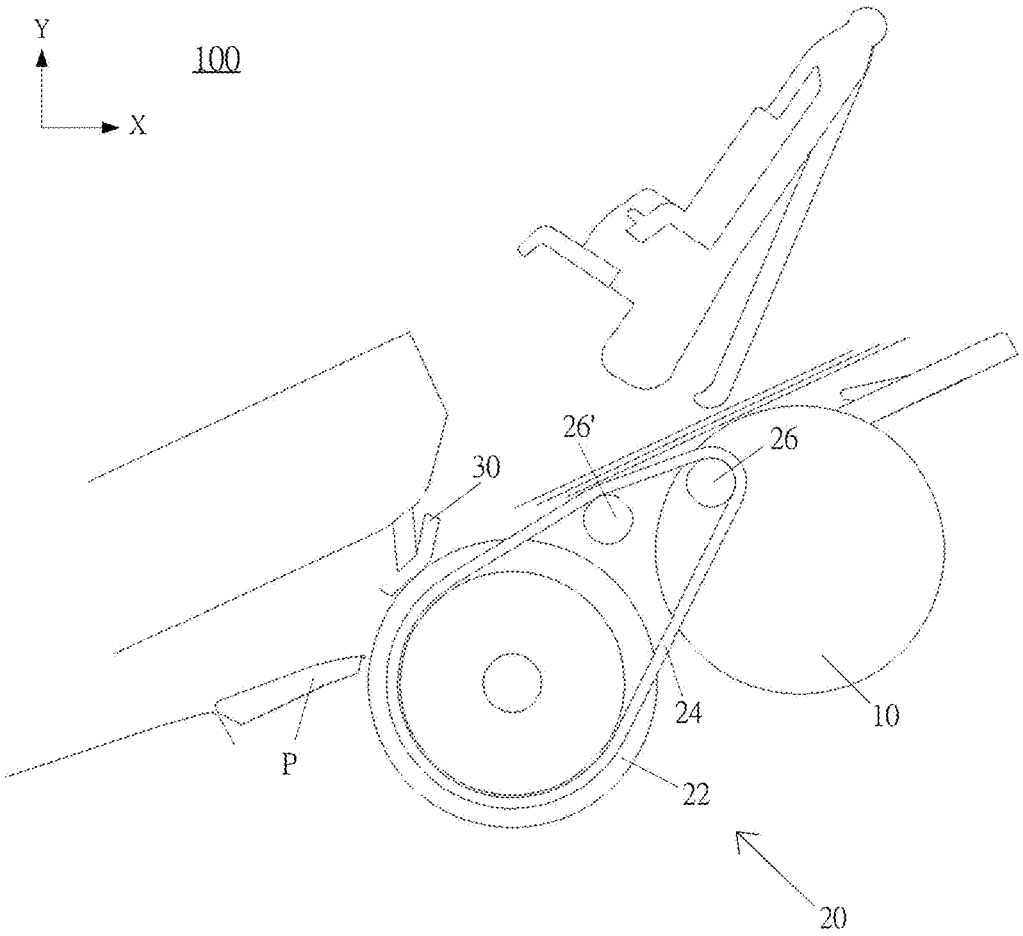
FIG. 6 is a diagram of the feeding device according to a third embodiment of the present invention.

Please refer to FIG. 6. FIG. 6 is a diagram of the feeding device 100 according to a third embodiment of the present invention. Different from the second embodiment, the sheet-feeding module 20 further includes a second idle wheel 26' disposed between the first idle wheel 26 and the sheet-feeding roller 22, and the belt 24 further encircles the second idle wheel 26'. By adding the second idle wheel 26', a contacting area between the belt 24 and the sheet S is increased, which helps the belt 24 to drive the sheet S better.

Figure 7:
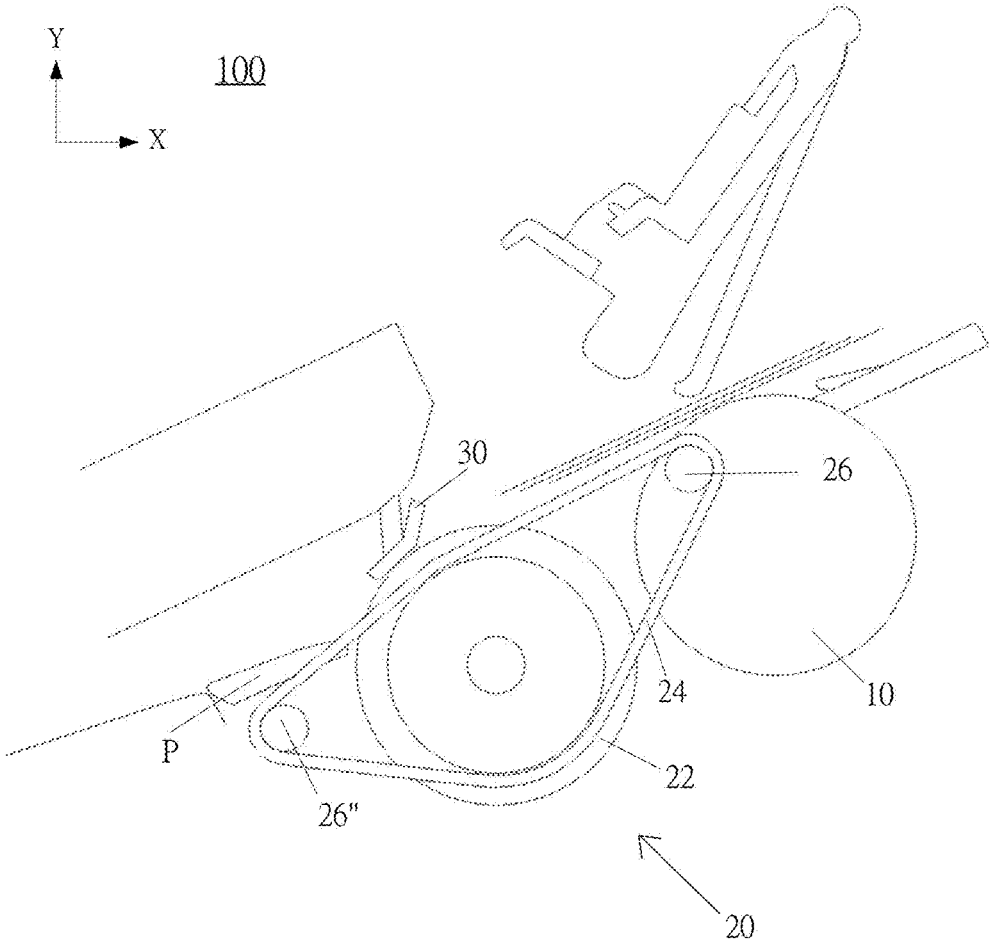
FIG. 7 is a diagram of the feeding device according to a fourth embodiment of the present invention.

Please refer to FIG. 7. FIG. 7 is a diagram of the feeding device 100 according to a fourth embodiment of the present invention. Different from the second embodiment, the sheet-feeding module 20 further includes a third idle wheel 26' disposed at a downstream side of the sheet-feeding roller 22, and the belt 24 further encircles the third idle wheel 26'. By adding the third idle wheel 26", the belt 24 can extend to a downstream side of a sheet-feeding point where the sheet-feeding roller 22 and the friction device 30 contact, i.e., where the sheet-feeding roller 22 and the paper passage P are connected. In such a way, when the sheet S passes through the sheet-feeding point, the belt 24 can convey the sheet S to the paper passage P at the downstream of the sheet-feeding roller 22 even if the sheet S deflects and goes down, such that the sheet S does not get stuck into a seam between the sheet-feeding roller 22 and the paper passage P.

Figure 8:
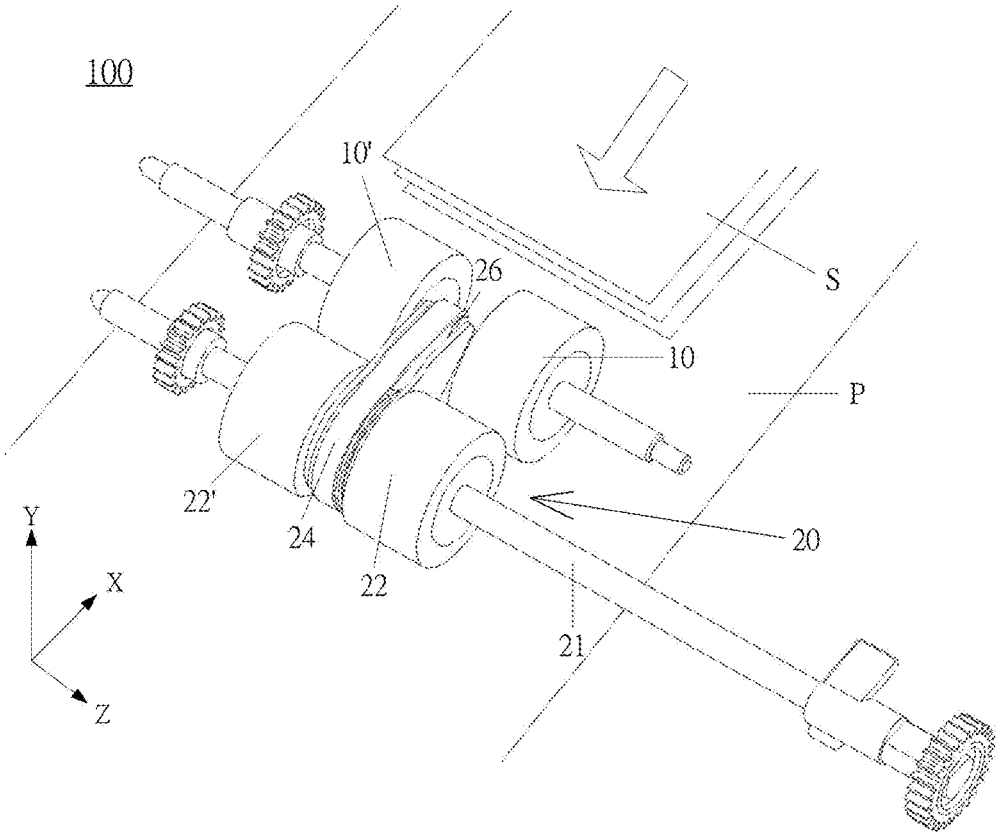
FIG. 8 is a diagram of the feeding device according to a fifth embodiment of the present invention.
Figure 9:
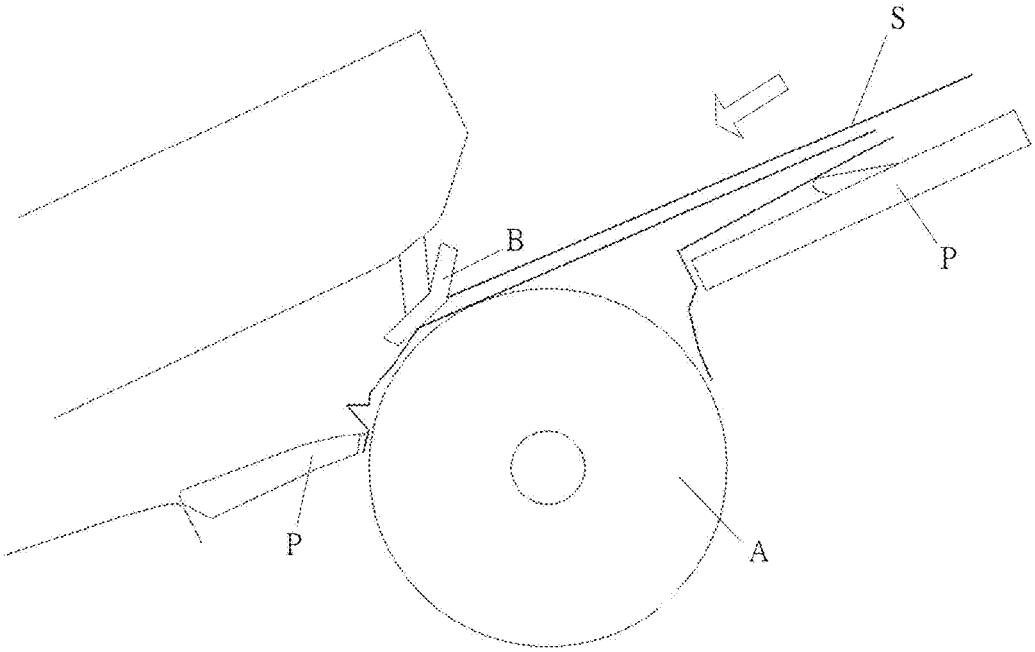
FIG. 9 PRIOR ART
FIG. 9 is a diagram of a conventional feeding device in the prior art.
Figure 10:
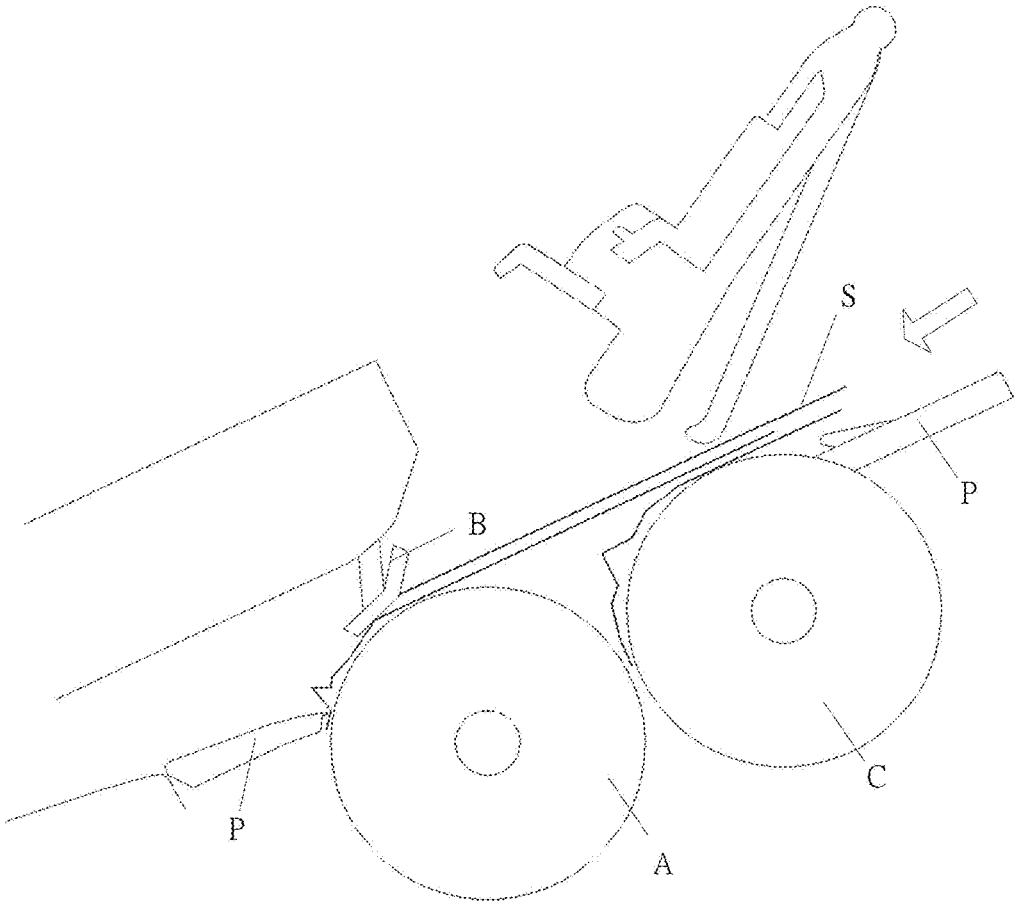
FIG. 10 PRIOR ART
FIG. 10 is a diagram of another conventional feeding device in the prior art.

Please refer to FIG. 8. FIG. 8 is a diagram of the feeding device 100 according to a fifth embodiment of the present invention. Different from the second embodiment, the sheet-feeding module 20 further includes an additional sheet-feeding roller 22' disposed coaxially with the sheet-feeding roller 22, and the feeding device 100 further includes an additional pickup roller 10' disposed coaxially with the pickup roller 10. The pickup roller 10 and the additional pickup roller 10' are disposed at two opposite sides of the belt 24. Similarly, the sheet-feeding roller 22 and the additional sheet-feeding roller 22' are disposed at two opposite sides of the belt 24. The pickup roller 10 and the additional pickup roller 10' can be the same components. The sheet-feeding roller 22 and the additional sheet-feeding roller 22' can be the same components. In such a way, the forces received by the sheet S can be balanced and equalized when the sheet S is picked up or separated, such that the sheet S is not deflected due to uneven forces during the feeding process.

In contrast to the prior, the present invention provides the feeding device capable of guiding the sheet by utilizing the belt to contact the sheet and drive the sheet to move when the sheet is picked up or separated, such that the sheet is not extremely bent by a force. Therefore, the sheet can pass through a space between the paper passage and the sheet-feeding roller or between the pickup roller and the sheet-feeding roller, instead of being stuck into seams therebetween, and can be conveyed to the paper passage at the downstream of the sheet feeding roller one by one continuously, which protects the sheet from damage and ensures a smooth sheet-feeding process.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A feeding device for a digital processing machine, the feeding device comprising:

a paper passage;

a friction device; and a sheet-feeding module disposed on the paper passage and at a location opposite to the friction device, the sheet-feeding module comprising:

a sheet-feeding roller for separating a sheet with the friction device;

a first idle wheel disposed on an upstream side of the sheet-feeding roller;

a belt encircling the first idle wheel and an axle of the sheet-feeding roller; and a supporting frame installed on and driven by the axle of the sheet-feeding roller and independent from the first idle wheel, the belt encircling the supporting frame;

wherein the sheet-feeding module rotates from a first position to a second position when the sheet-feeding roller rotates, such that the belt contacts the sheet when the sheet-feeding module is at the second position, the sheet-feeding module further comprises a idle wheel disposed at a downstream side of the sheet-feeding roller, and the belt further encircles the idle wheel.

2. The feeding device of claim 1, wherein the second position is higher than the first position along a direction substantially perpendicular to the paper passage.

3. The feeding device of claim 1, wherein the belt is driven by the sheet-feeding roller to drive the sheet.

4. The feeding device of claim 1, further comprising a pickup roller disposed on the paper passage and at an upstream side relative to the sheet-feeding roller, the pickup roller being for conveying the sheet to the sheet-feeding roller.

5. The feeding device of claim 4, further comprising an additional pickup roller disposed coaxially with the pickup roller.

6. The feeding device of claim 1, wherein the sheet-feeding module further comprises an additional sheet-feeding roller disposed coaxially with the sheet-feeding roller.

7. The feeding device of claim 1, wherein the sheet-feeding module comprises a second idle wheel disposed between the first idle wheel and the sheet-feeding roller, and the belt further encircles the second idle wheel.

8. The feeding device of claim 1, further comprising a power source connected to the sheet-feeding roller and for driving the sheet-feeding roller to rotate.

* * * * *